US010254006B2

(12) United States Patent
Hong et al.

(10) Patent No.: US 10,254,006 B2
(45) Date of Patent: Apr. 9, 2019

(54) COMPRESSOR NOISE SUPPRESSING STRUCTURE AND DEHUMIDIFIER HAVING THE SAME

(71) Applicants: COWAY CO., LTD, Chungcheong-nam-do (KR); WINIX INC., Gyeonggi-do (KR)

(72) Inventors: Hyun-Jin Hong, Seoul (KR); Chan-Jung Park, Seoul (KR); Sang-Woo Kang, Seoul (KR)

(73) Assignee: COWAY CO., LTD, Chungcheong-nam-do (KR)

( * ) Notice: Subject to any disclaimer, the term of this patent is extended or adjusted under 35 U.S.C. 154(b) by 114 days.

(21) Appl. No.: 14/382,972

(22) PCT Filed: Dec. 28, 2012

(86) PCT No.: PCT/KR2012/011756
§ 371 (c)(1),
(2) Date: Sep. 4, 2014

(87) PCT Pub. No.: WO2013/141470
PCT Pub. Date: Sep. 26, 2013

(65) Prior Publication Data

US 2015/0033785 A1 Feb. 5, 2015

(30) Foreign Application Priority Data

Mar. 20, 2012 (KR) ..... 10-2012-0028512
Jun. 8, 2012 (KR) ..... 10-2012-0061575
Dec. 12, 2012 (KR) ..... 10-2012-0144775

(51) Int. Cl.
*F24F 13/24* (2006.01)
*F24F 3/14* (2006.01)
*F24F 1/12* (2011.01)

(52) U.S. Cl.
CPC ..... *F24F 13/24* (2013.01); *F24F 1/12* (2013.01); *F24F 3/14* (2013.01)

(58) Field of Classification Search
CPC ..... F24F 13/24; F24F 1/12; F24F 3/24
(Continued)

(56) References Cited

U.S. PATENT DOCUMENTS 1,933,771 A * 11/1933 Strang ..... F24F 1/025 454/204
2,080,595 A * 5/1937 Anderson ..... F25D 23/003 62/296

(Continued)

FOREIGN PATENT DOCUMENTS

CN 2231389 7/1996
CN 1134537 10/1996

(Continued)

OTHER PUBLICATIONS

International Search Report PCT/KR2012/011756 (2 Pages) dated Apr. 5, 2013.

(Continued)

*Primary Examiner* — Ljiljana V. Ciric
*Assistant Examiner* — Kirstin U Oswald
(74) *Attorney, Agent, or Firm* — Dority & Manning, P.A.

(57) ABSTRACT

A compressor noise suppressing structure including a dehumidifier. The compressor noise suppressing structure includes an installation member fixed to a base frame to support and accommodate a component installed within a housing, and a noise-proof member attached to the installation member and extending towards a first end of the base so as to cover at least one side of the compressor. According to the configuration of the compressor noise suppressing structure, noise generated when the compressor is operated is simultaneously blocked by the nose-proof member and the (Continued)

housing, and the installation member and the noise-proof member are configured as a single component.

11 Claims, 7 Drawing Sheets

(58) Field of Classification Search
USPC ..... 62/285, 296
See application file for complete search history.

(56) References Cited

U.S. PATENT DOCUMENTS

| | | | | | |
|---|---|---|---|---|---|
| 2,112,221 | A * | 3/1938 | Armstrong | F24F 1/00 | 165/48.1 |
| 2,140,305 | A * | 12/1938 | Ashley | F24F 1/022 | 165/123 |
| 2,236,111 | A * | 3/1941 | Philipp | F25D 23/003 | 417/201 |
| 2,254,654 | A * | 9/1941 | Holmes | F24F 1/022 | 62/291 |
| 2,265,272 | A * | 12/1941 | Ditzler | 165/48.1 | |
| 2,286,491 | A * | 6/1942 | Kueher | F24F 1/02 | 62/183 |
| 2,486,226 | A * | 10/1949 | Trask | F24F 1/025 | 62/289 |
| 2,580,535 | A * | 1/1952 | Feinberg | F24F 1/02 | 62/285 |
| 2,759,334 | A * | 8/1956 | Burgess | F24F 3/001 | 165/76 |
| 2,773,676 | A * | 12/1956 | Boyle | F24F 1/02 | 165/48.1 |
| 3,018,642 | A * | 1/1962 | Lathrop | F24F 1/02 | 62/262 |
| 3,091,288 | A * | 5/1963 | Williams | F24F 3/0522 | 165/48.1 |
| 3,142,162 | A * | 7/1964 | Herndon, Jr. | F25D 23/006 | 248/613 |
| 3,162,023 | A * | 12/1964 | Smith | F25D 23/003 | 62/155 |
| 3,524,328 | A * | 8/1970 | Schuster | F24F 1/02 | 165/122 |
| 3,714,795 | A * | 2/1973 | Fowell | F24F 1/10 | 62/181 |
| 3,799,703 | A * | 3/1974 | Paine | F24F 13/24 | 181/202 |
| 3,888,090 | A * | 6/1975 | Meyer | B63J 2/04 | 62/217 |
| 4,416,327 | A * | 11/1983 | Nakada | F24F 13/20 | 165/122 |
| 4,432,434 | A * | 2/1984 | Dean, Jr. | F24F 13/24 | 181/224 |
| 4,441,546 | A * | 4/1984 | VanderVaart | F24D 11/02 | 165/231 |
| 4,462,460 | A * | 7/1984 | Braver | F24F 1/0033 | 165/207 |
| 4,982,812 | A * | 1/1991 | Hwang | F04B 39/0033 | 181/202 |
| 4,991,406 | A * | 2/1991 | Fujii | F24F 1/56 | 62/259.1 |
| 5,669,232 | A | 9/1997 | Iwamoto et al. | | |
| 5,943,873 | A * | 8/1999 | Chung | F24F 1/027 | 62/262 |
| 6,092,794 | A * | 7/2000 | Reens | B01F 3/04049 | 261/115 |
| 6,370,899 | B1 * | 4/2002 | Hobbs | F24F 13/20 | 62/259.1 |
| 2004/0144116 | A1 * | 7/2004 | Kim | F24F 1/027 | 62/262 |
| 2011/0016904 | A1 | 1/2011 | Yoon | | |

FOREIGN PATENT DOCUMENTS

| | | | | | |
|---|---|---|---|---|---|
| CN | 101260887 | | 9/2008 | | |
| CN | 101684956 | | 3/2010 | | |
| EP | 1300635 | A2 * | 4/2003 | F24F 1/12 | |
| EP | 1300635 | A2 * | 4/2003 | F24F 1/12 | |
| JP | 2001-004169 | | 1/2001 | | |
| JP | 2005-147619 | | 6/2005 | | |
| JP | 2011-052842 | | 3/2011 | | |
| KR | 2004-0031207 | | 4/2001 | | |
| KR | 2003-0077283 | | 1/2003 | | |
| WO | WO 2010062003 | A1 * | 6/2010 | F24F 6/00 | |
| WO | WO-2010062003 | A1 * | 6/2010 | F24F 6/00 | |

OTHER PUBLICATIONS

Written Opinion of the International Searching Authority PCT/KR2012/011756 (5 Pages) dated Apr. 4, 2013.
The State Intellectual Property Office of China.
Chinese Office Action and English Translation CN 2012800716167.7, dated Aug. 2, 2016, (15 pages).

* cited by examiner

[Fig. 1]
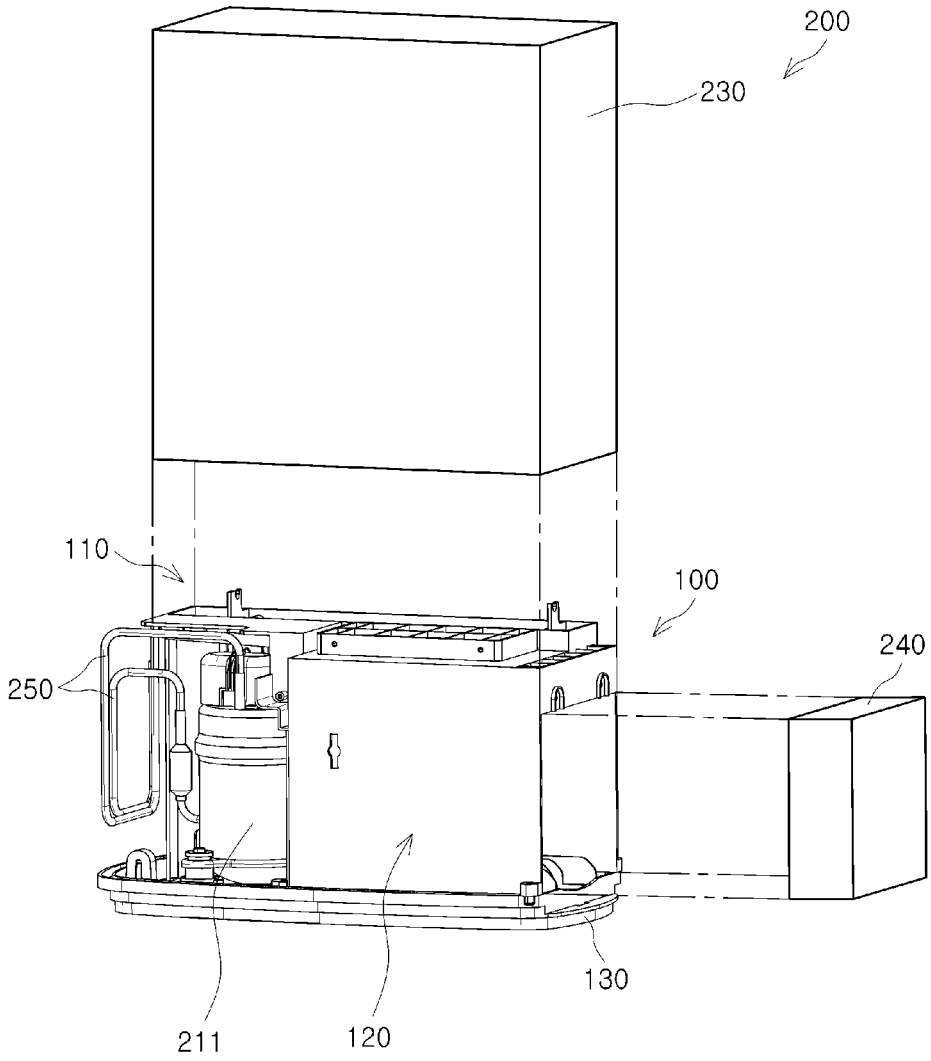

[Fig. 2]
(a)
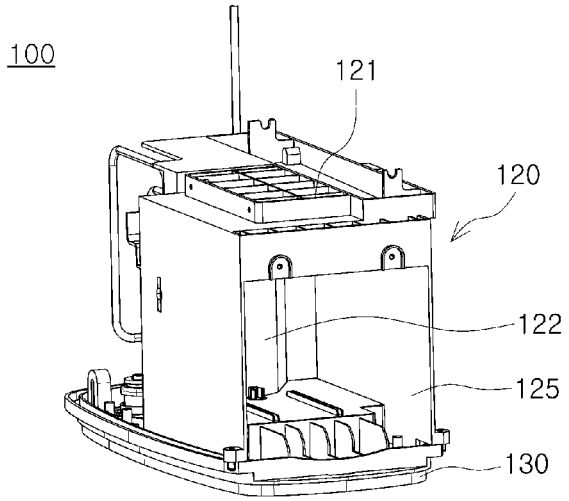
(b)
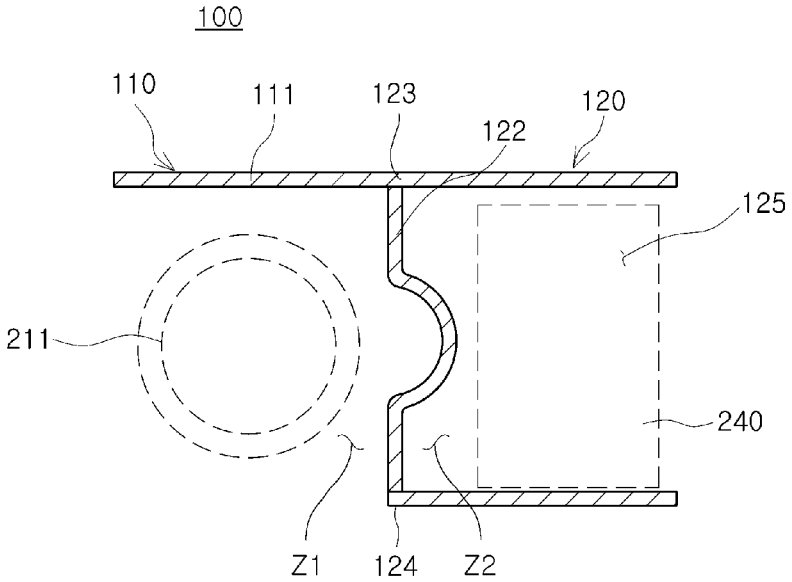

[Fig. 3]
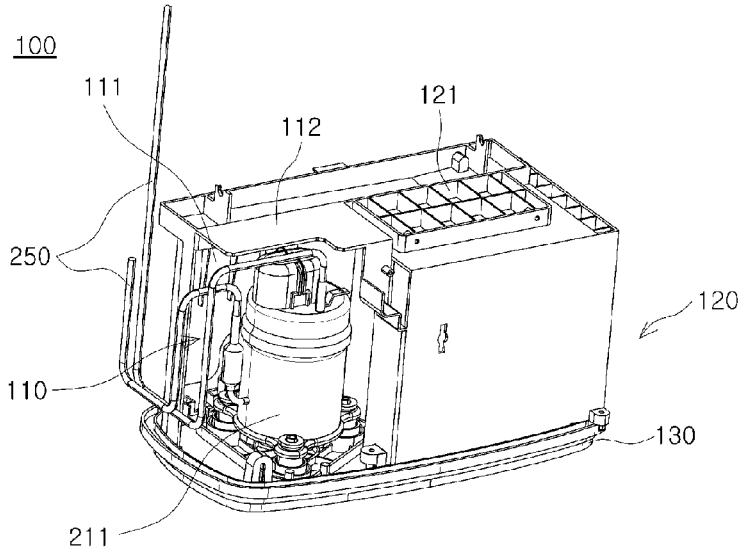
[Fig. 4]
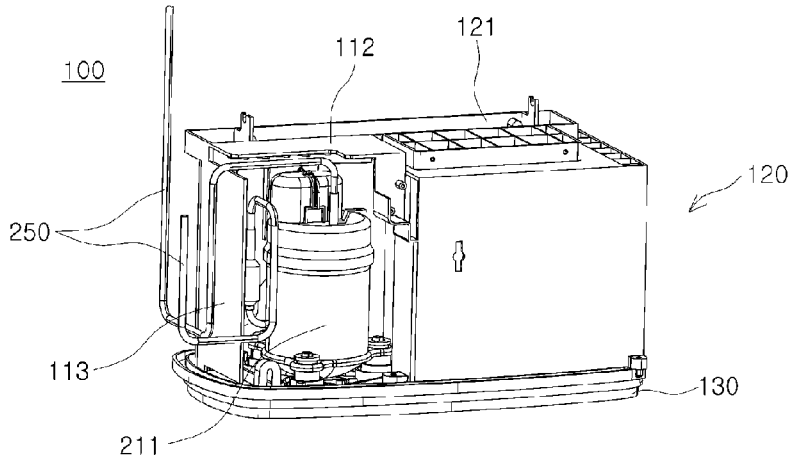
[Fig. 5]
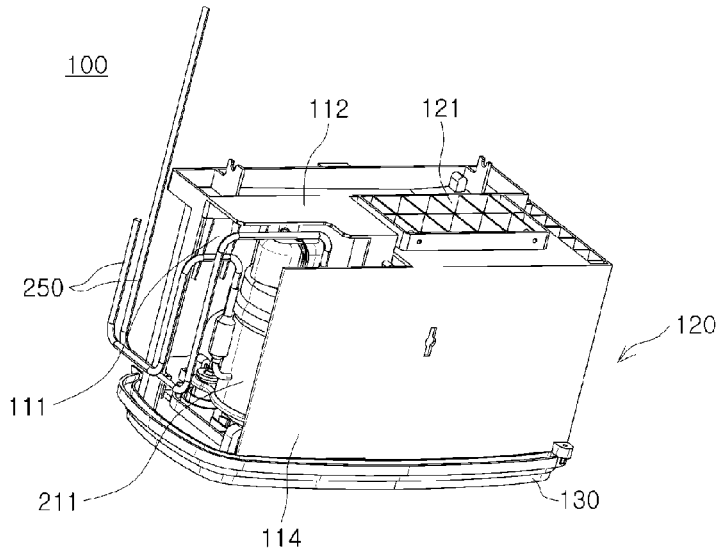

[Fig. 6]
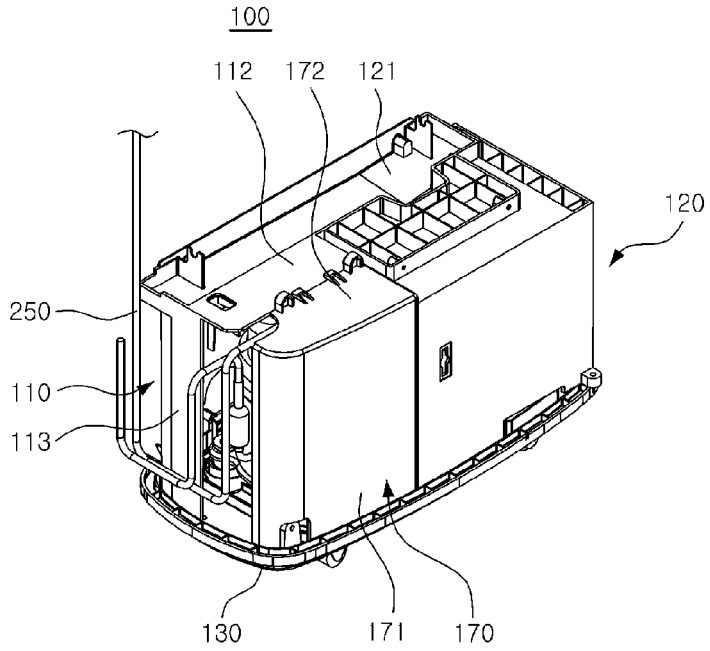
[Fig. 7]
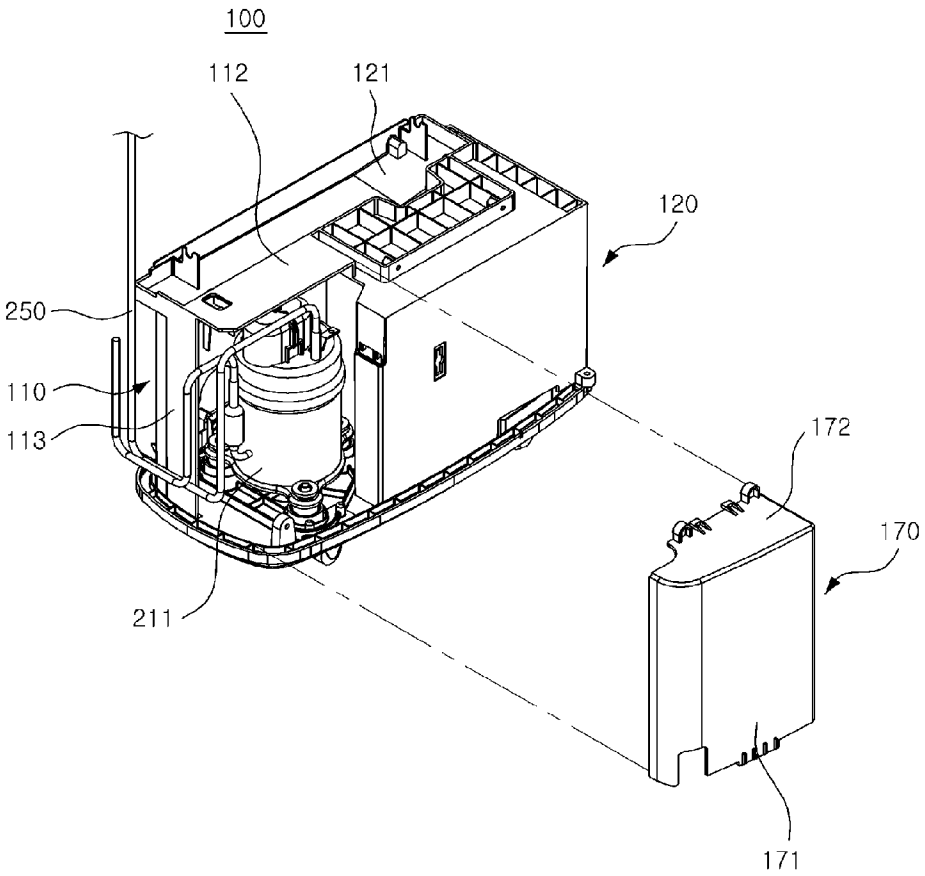

[Fig. 8]
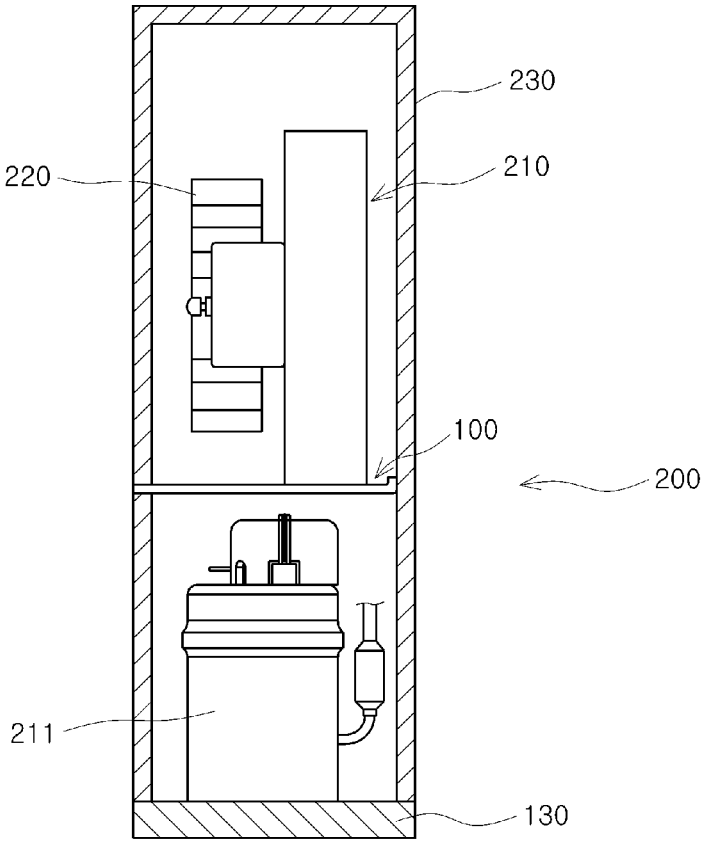
[Fig. 9]
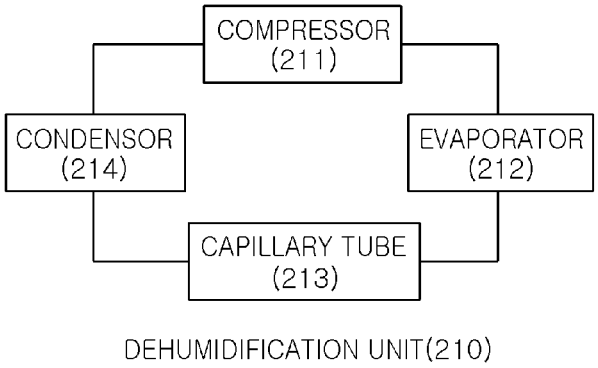

[Fig. 10]
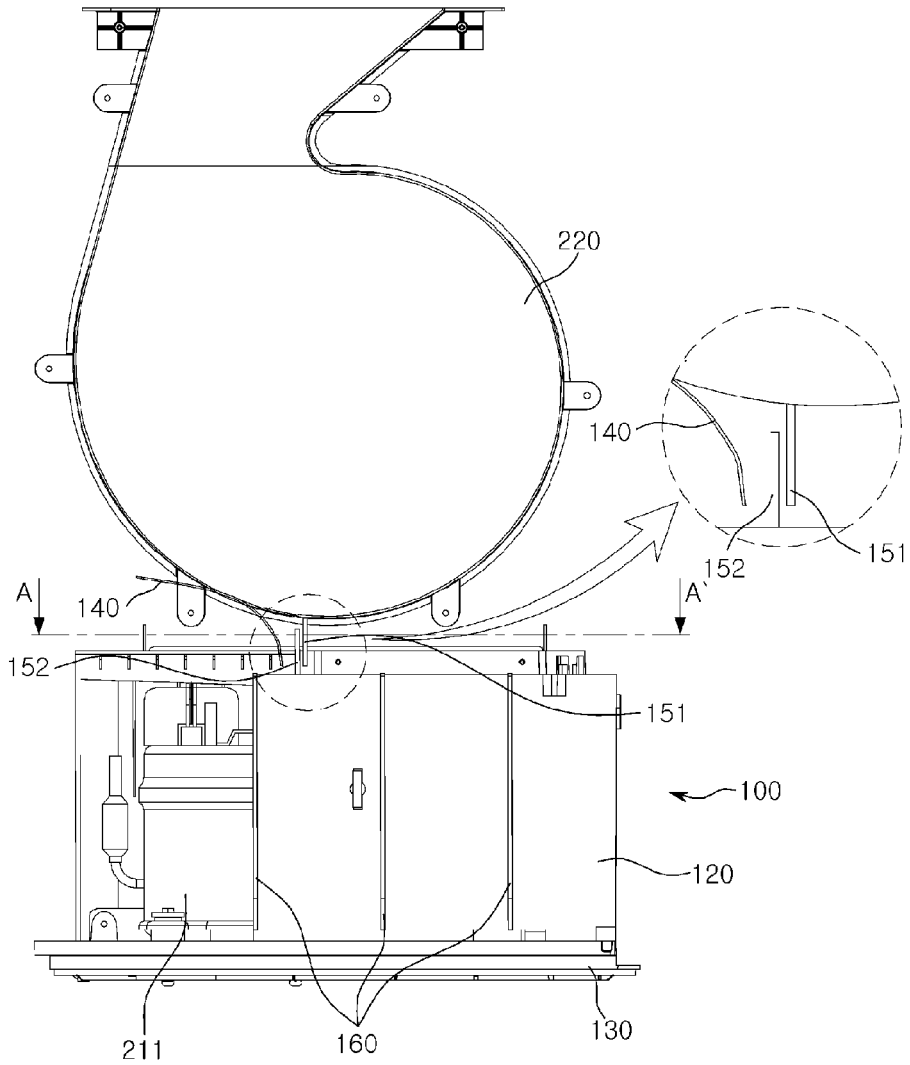
[Fig. 11]
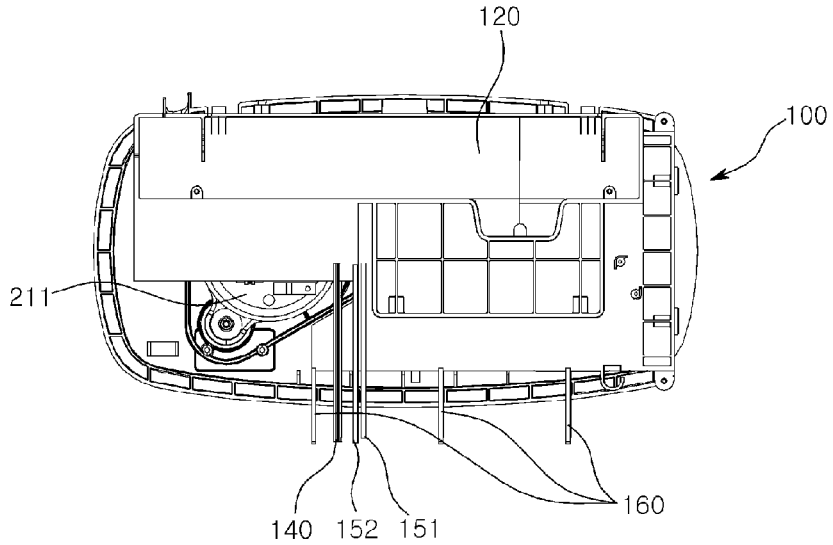

[Fig. 12]
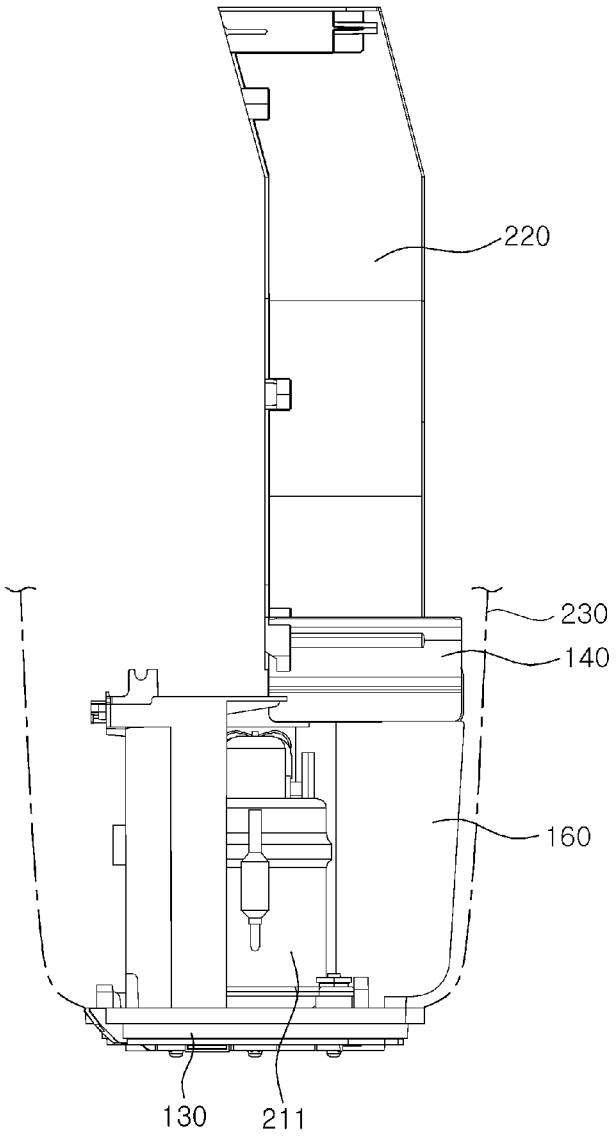

COMPRESSOR NOISE SUPPRESSING STRUCTURE AND DEHUMIDIFIER HAVING THE SAME

CROSS REFERENCE TO RELATED APPLICATIONS

This application is the U.S. National Stage entry of International Application Number PCT/KR2012/011756, filed under the Patent Cooperation Treaty having a filing date of Dec. 28, 2012, which claims priority to Korean Patent Application Serial Number 10-2012-0028512, having a filing date of Mar. 20, 2012, Korean Patent Application Serial Number 10-2012-0061575 having a filing date of Jun. 8, 2012 and Korean Patent Application Serial Number 10-2012-0144775, having a filing date of Dec. 12, 2012.

TECHNICAL FIELD

The present invention relates to a compressor noise suppressing structure for suppressing noise generated during compressor operation and a dehumidifier having the same, and more particularly, to a compressor noise suppressing structure in which a compressor is simultaneously covered by a housing and a component, the component being formed to extend from a different component so as to be integrated therewith, and a dehumidifier having the same.

BACKGROUND ART

A mechanism or device using a refrigerating cycle such as a refrigerator, a dehumidifier, or the like, uses a compressor as an internal component. The refrigerating cycle includes a compressor compressing a heat exchange refrigerant to have high temperature and high pressure, a condenser releasing heat from the refrigerant compressed to have high temperature and high pressure in the compressor, a capillary tube lowering pressure of the refrigerant having pressure increased by the condenser, and an evaporator evaporating the refrigerant which has passed through the capillary tube to lower a temperature thereof. Here, when the compressor compresses a refrigerant as a heat exchange material to have a high temperature high pressure state, a large amount of noise and heat are generated.

In the related art, a circumference of the compressor is covered by a sound absorbing material component to reduce noise generated when the compressor operates, but in this case, there is a difficulty in dissipating heat generated by the compressor.

In particular, when heat dissipation is hindered, a temperature of the compressor increases which increases a load of the compressor, resulting in an increase in vibrations of the compressor. Thus, simply covering the circumference of the compressor with the sound absorbing material component causes a large amount of noise due to poor heat dissipation, and thus, the effect of reducing noise by installing an acoustic absorbent may be insufficient.

DISCLOSURE OF INVENTION

Technical Problem

An aspect of the present invention provides a compressor noise suppressing structure capable of effectively suppressing noise generated when a compressor operates, and a dehumidifier having the same.

Also, an aspect of the present invention also provides a compressor noise suppressing structure capable of effectively dissipating heat, as well as suppressing noise generated by a compressor, and a dehumidifier having the same.

Also, an aspect of the present invention also provides a compressor noise suppressing structure in which a noise-proof member covering an outer appearance of a compressor and an installation member accommodating a component within a dehumidifier are integrated into a single component to thereby simplify an assembly process and reducing costs for manufacturing products, and a dehumidifier having the same.

Solution to Problem

According to an aspect of the present invention, there is provided a compressor noise suppressing structure installed in a device having a compressor to suppress noise from the compressor, including: an installation member fixed to a base frame to support and accommodate a component installed within a housing; and a noise-proof member extending from the installation member to cover at least one side of the compressor to block noise from the compressor.

Preferably, the noise-proof member extends from the installation member to cover the compressor such that at least one side of the compressor is opened, to block noise from the compressor.

Preferably, an upper region of the base frame is divided into a region where the compressor is installed and a region positioned opposite to the compressor, and the installation member has a partition installed between the region with compressor and the region opposite to the compressor in order to block noise generated by the compressor from being transmitted to the other region.

More preferably, the installation member may include space in which a water storage tank is installed to accommodate water dripping from an internal condenser.

Preferably, the installation member may have a mounting surface formed on an upper portion thereof to allow a component to be installed thereon.

Preferably, the noise-proof member may include a first extending member extending from one side of a wall portion of the installation member toward the compressor to cover one side of the compressor and an upper extending member extending from an upper surface of the installation member to cover at least a portion of the upper surface of the compressor, wherein the first extending member and the upper extending member may be integrally formed with the installation member.

Also, preferably, the noise-proof member may further include a bent member bent from the first extending member and extending to cover the compressor, and may further include a second extending member extending toward the compressor from the installation member, opposite to the first extending member, to cover one side of the compressor.

Also, the compressor noise suppressing structure may further include: a detachable soundproof member attached to the noise-proof member to cover the compressor.

Meanwhile, the compressor noise suppressing structure may further include: a blowing unit side soundproof member extending from one side of a blowing unit for discharging introduced air and installed above the installation member or the compressor, in order to suppress noise generated by the compressor from being transmitted to the blowing unit installed above the compressor.

Preferably, the blowing unit side soundproof member may be formed to have a curved surface to cover an upper portion of the compressor to reflect noise generated by the compressor rather than allowing the noise to be introduced to the blowing unit. Also, a sound absorbing member may be attached to the blowing unit side soundproof member.

Also, the compressor noise suppressing structure may further include: at least one downwardly extending soundproof member installed on an tipper portion of the installation member and extending from one side of the blowing unit for discharging introduced air toward an upper end of the installation member.

Also, the compressor noise suppressing structure may further include: at least one upwardly extending soundproof member extending upwardly from the installation member.

Here, the downwardly extending soundproof member and the upwardly extending soundproof member may be positioned to be adjacent and parallel to each other in order to simultaneously block noise generated by the compressor.

Preferably, the compressor noise suppressing structure may further include: at least one laterally extending soundproof member extending from a lateral surface of the installation member toward the housing.

According to another aspect of the present invention, there is provided a dehumidifier including: a blower for receiving humid air introduced thereto; a dehumidification unit for removing moisture from air introduced to the blower and for being accommodated in the foregoing compressor noise suppressing structure a water storage tank for storing water dripping from a condenser provided in the dehumidification unit; and a housing for accommodating the dehumidification unit, the blower, and the water storage tank.

Advantageous Effects of Invention

According to an embodiment of the present invention, noise generated when the compressor is operated can be blocked simultaneously by the housing and the noise-proof member installed therein.

Also, according to an embodiment of the present invention, since at least one side of the noise-proof member surrounding or covering the compressor is opened, heat generated by the compressor can be effectively dissipated.

Also, according to an embodiment of the present invention, since the noise-proof member covering the compressor and the installation member accommodating other components near the compressor, are integrally formed, an assembly process is simplified and fabrication costs can be reduced.

BRIEF DESCRIPTION OF DRAWINGS

FIG. 1 is an exploded, perspective view of a dehumidifier having a compressor noise suppressing structure according to an embodiment of the present invention.

FIG. 2 illustrates the compressor noise suppressing structure illustrated in FIG. 1, wherein (a) is a perspective view of the compressor noise suppressing structure and (b) is a cross-sectional view of the compressor noise suppressing stricture.

FIG. 3 is a perspective view of the compressor noise suppressing structure illustrated in FIG. 2(*a*) viewed at a different angle.

FIG. 4 is a perspective view of a compressor noise suppressing structure according to another embodiment of the present invention.

FIG. 5 is a perspective view of a compressor noise suppressing structure according to another embodiment of the present invention.

FIG. 6 is a perspective view of a compressor noise suppressing structure according to another embodiment of the present invention.

FIG. 7 is an exploded perspective view illustrating a state in which a noise-proof member is separated from the compressor noise suppressing structure illustrated in FIG. 6.

FIG. 8 is a side view illustrating an internal structure of a dehumidifier including a compressor noise suppressing structure according to an embodiment of the present invention.

FIG. 9 is a block diagram of a dehumidifier.

FIG. 10 is a front view illustrating an inner state of a dehumidifier according to another embodiment of the present invention.

FIG. 11 is a cross-sectional view taken along line A-A' in FIG. 10.

FIG. 12 is a side view of the dehumidifier illustrated in FIG. 10.

BEST MODE FOR CARRYING OUT THE INVENTION

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity.

First, a compressor described according to an embodiment of the present invention may be used in a refrigerator, a dehumidifier, or the like, using a refrigerating cycle, and in the present disclosure, a compressor noise suppressing structure 100 provided in a dehumidifier 200 will be described as an example. However, the compressor noise suppressing structure 100 is not limited to the dehumidifier 200 and may be employed in any device as long as the device is required to suppress noise generated by a compressor.

As illustrated in FIG. 1, the compressor noise suppressing structure 100 according to an embodiment of the present invention may include an installation member 120 and a noise-proof member 110.

The installation member 120 may support and accommodate components installed within the housing 230 and fixed to a base frame 130. The base frame 130 may coupled to the bottom of the housing 230 to accommodate the compressor noise suppressing structure 100 together with the housing 230 to form an outer appearance of the apparatus. The installation member 120 may be fixed to an upper portion of the base frame 130.

Also, the installation member 120 may have a mounting surface 121 formed on an upper surface thereof to allow components to be installed or supported thereon within the housing 230. As illustrated in FIG. 9, the dehumidifier 200 according to an embodiment of the present invention may include a condenser 214, a capillary tube 213, and an evaporator 212, besides a compressor 211 constituting a refrigerating cycle within the housing 230. Also, in order to expel dehumidified air, the dehumidifier 200 may include a component such as a blowing unit 220 having a scroll casing, a fan, a motor, or the like. Thus, the installation member 120 may be configured to have the mounting surface 121 provided on upper surface thereof to accommodate or support at least some of the foregoing components.

Also, the installation member 120 may have installation space 125 formed therein to accommodate a component. In the case of the dehumidifier 200 according to an embodiment of the present invention, a water storage tank 240 accommodating water condensed by the condenser 214 may be provided in the installation space 125. The water storage tank 240 may be installed to be positioned on the underneath of the condenser 214, and to this end, the water storage tank 240 may be accommodated in the space 125 formed within the installation member 120.

The noise-proof member 110 may extend from the installation member 120 to cover at least one side of the compressor 211. The compressor 211 may have a structure installed on the base frame 130, so the noise-proof member 110 is not required to cover a lower side of the compressor 211. Thus, in the present disclosure, it is assumed that covering at least one side of the compressor 211 by the noise-proof member 110 means that the noise-proof member 110 is installed to cover at least a portion of five sides (a front side, a rear side, left and right sides, and an upper side), excluding the lower side among the six sides of the compressor 211.

The noise-proof member 110 may be integrally formed with the installation member 120 supporting or accommodating components installed within the housing 230, thus providing a soundproof effect and simplifying the assembly process.

Meanwhile, as illustrated in FIG. 2(*b*), the upper region of the base frame 130 is divided into a region Z1 in where the compressor 211 is installed and a region Z2 positioned opposite to the compressor 211. The installation member 120 may have a partition 122 installed between the region Z1 with compressor and the region Z2 opposite to the compressor 211 in order to block noise generated by the compressor 211 from being transmitted to the other region Z2.

Namely, in order to block noise from the compressor 211, the partition 122 may be installed in a portion from which the noise-proof member 110 starts to extend.

In this manner, the partition 122 installed on the installation member 120 has a structure covering one side (the right side) of the circumference of the compressor 211, and the noise-proof member 110 covers at least a portion of the other remaining four sides (the front side, the rear side, the left side, and the upper side) excluding the lower side and the right side of the circumference of the compressor 211.

Meanwhile, the configuration in which the noise-proof member 110 covers the entire sides (i.e., the six sides including the lower side covered by the base frame 130 and the right side covered by the partition 122) of the compressor 211 together with the frame 130 and/or the partition 122 may be desirable in terms of noise blocking at an initial stage of driving the compressor 211.

Namely, covering the entire sides of the compressor 211 with the noise-proof member 110 may be advantageous in terms of noise blocking at the initial stage of driving the compressor 211, but in this case, after the compressor 211 is driven for a predetermined period of time, heat generated by the compressor 211 cannot be effectively emitted, increasing a temperature of the compressor 211. The increased temperature of the compressor 211 increases a load of the compressor to increase vibrations of the compressor 211. Namely, the defective heat dissipation causes additional noise, which is disadvantageous in terms of noise blocking.

Thus, in an embodiment of the present invention, preferably, the noise-proof member 110 extends from the installation member 120 to cover the compressor 211 such that at least one side of the compressor 211 is opened.

Also, since the compressor 211 has a connection pipe 250 connected to the condenser 214, the evaporator 212, and the capillary tube 213 constituting a refrigerating cycle, if the circumference of the compressor 211 is entirely covered, it will be difficult to install the connection pipe 250, or the like. Thus, preferably, the noise-proof member 110 may be configured to cover the compressor 211 such that at least one of the sides of the compressor 211 is opened.

For example, as illustrated in FIGS. 2 and 3, the noise-proof member 110 may include a first extending member 111 extending from a first surface 123 as one side of a wall portion of the installation member 120 toward the compressor 211 to cover one side of the compressor 211 and an upper extending member 112 extending from an upper surface of the installation member 120, i.e., from the mounting surface 121, toward the compressor 211 to cover at least one portion of the upper surface of the compressor 211. In this case, the bottom of the compressor 211 is coupled to the base frame 130 and the right side thereof is surrounded by the partition 122, the noise-proof member 110 is configured to allow the two sides (the left side and the front side) of the compressor 211 to be opened. As illustrated in FIGS. 2 and 3, the partition 122 of the installation member 120 serves as one side (the right side) of the noise-proof member 110 covering the compressor 211.

Also, as illustrated in FIG. 4, the noise-proof member 110 may further include a bent member 113 bent from an end portion of the first extending member 111 to cover the compressor 211, in addition to the first extending member 111 and the upper extending member 112. The bent member 113 may cover the entirety of one side of the compressor 211, or as shown in FIG. 4, the bent member 113 may be formed to be bent forwardly from the first extending member 111 to cover a portion of one side of the compressor 211.

Meanwhile, in the configuration of FIG. 4, the partition 122 of the installation member 120 serves as one side (the right side) of the noise-proof member 110 covering the compressor 211. In this case, the compressor 211 is configured such that one side (the front side) thereof among the entire sides thereof is open, having a more effective structure than the structure having two opened sides (the left side and the front side in FIG. 3) in terms of noise-proofing effect, and heat of the compressor 211 can be smoothly dissipated through the opened first side.

As illustrated in FIG. 5, in another embodiment of the present invention, the noise-proof member 110 may include the first extending member 111 extending from one side of the first surface 123, a second extending member 114 extending from the other side (Please see 124 in FIG. 2(*b*)) of the first surface 123, and the foregoing upper extending member 112. Here, the second extending member 114 extends toward the compressor 211 from the installation member 120 on the side opposing the first extending member 111 to cover one side (the front side) of the compressor 211. In the case of the configuration of FIG. 5, the partition 122 of the installation member 120 serves as one side (the right side) of the noise-proof member 110 covering the compressor 211. Also, in this case, similar to the configuration of FIG. 4, the compressor 211 is configured such that one side (the left side), among the entire six sides surrounding the compressor 211, is opened, which is more effective, in terms of noise suppressing effect, than the structure in which two sides (i.e., the left side and the front side in the configuration of FIG. 3) are opened.

Here, like the first extending member 111 and the upper extending member 112, the second extending member extends from the installation member 120 so as to be integrally formed with the installation member 120. Since the noise-proof member 110 is integrally formed with the installation member 120, the noise-proof member 110 is not required to be separately assembled, improving assembly characteristics.

Meanwhile, as illustrated in FIGS. 6 and 7, the compressor noise suppressing structure 100 according to an embodiment of the present invention may further include a detachable soundproof member 170 attached to the noise-proof member to cover the compressor 211, in association with the noise-proof member 110.

In detail, it is not easy to fabricate the noise-proof member 110 covering several sides of the compressor 211 such that it extends from the installation member 120 so as to be integrally formed with the installation member 120, in terms of a mold structure. Also, it is difficult to assemble a plurality of connection pipes 250 and wirings connected to the compressor. Thus, the detachable soundproof member 170 may be configured as a separate component, the compressor 211 and the connection pipes 250 and wirings connected to the compressor 211 are installed, and the detachable soundproof member 170 may be subsequently attached to the noise-proof member 110 and/or the installation member 120.

Here, as illustrated in FIGS. 6 and 7, the detachable soundproof member 170 includes a front covering portion 171 extending to the compressor 211 from the installation member 120 on the opposite side of the first extending member 111 to cover one side (the front side) of the compressor 211 and an upper covering portion 172 covering an upper side of the compressor 211 together with the upper extending member 122.

However, as described hereinafter, when heat dissipation efficiency is weighed relative to a noise-proof effect through the detachable soundproof member 170, the detachable soundproof member 170 may not be installed, the upper covering portion 172 of the detachable soundproof member 170 may not be provided, or an opening may be formed in the upper covering portion 172 to reduce a reduction in the heat dissipation effect due to the detachable soundproof member 170. Whether to employ the detachable soundproof member 170, a size and a shape of the surface covering the compressor 211, and the like, may be regulated based on capacity (e.g., capacity of the evaporator) of the refrigerating system including the compressor 211.

Meanwhile, the compressor may only be covered with one of the upper extending member 112, the first extending member 111, the second extending member 114, and the bent member 114 of the noise-proof member 110.

In this manner, when the noise-proof member 110 is covered with the noise-proof member 110 with at least one side thereof opened, noise of the compressor 211 can be suppressed and heat generated by the compressor 211 can be effectively dissipated.

Meanwhile, the compressor noise suppressing structure 100 may be included in the dehumidifier 200 according to an embodiment of the present invention. The dehumidifier 200 using a refrigerating cycle employs the compressor 211.

As illustrated in FIGS. 8 and 9, a dehumidification unit 210 removing moisture from air introduced to the dehumidifier 200 may include the compressor 211 compressing a heat exchange refrigerant into a high temperature high pressure refrigerant, a condenser 214 emitting heat of the refrigerant compressed by the compressor 211 to have a high temperature and high pressure, a capillary tube 213 lowering pressure of the refrigerant having pressure increased by the condenser 214, and an evaporator 212 evaporating the refrigerant passing through the capillary tube 213 to decrease a temperature thereof to thus change vapor in the air into water to remove moisture. Also, besides the dehumidification unit 210, the dehumidifier 200 may include the blowing unit 220 discharging dehumidified air to the outside.

Here, when the dehumidifier 200 operates, noise generated by the compressor 211 may be suppressed by the noise-proof member 110 and/or the soundproof members 140, 151, 152, 160, and 170, or the like, as described hereinafter.

Also, the dehumidifier 200 according to an embodiment of the present invention may allow a component, e.g., the condenser 214, used in the dehumidification unit 210, to be installed and supported in the installation member 120 of the compressor noise suppressing structure 100. Also, the compressor noise suppressing structure 100 accommodating the water storage tank 240 storing condensed water generated by the condenser 214 during a dehumidification process may be included in the dehumidifier 200.

Meanwhile, as illustrated in FIGS. 10 to 12, the compressor noise suppressing structure 100 according to another embodiment of the present invention may further include a blowing unit side soundproof member 140 extending from one side of the blowing unit 220 provided above the installation member 120 to an upper portion of the compressor 211 or the installation member 120.

In order to suppress noise generated by the compressor 211 from being transmitted to an upper end of the compressor 211, the blowing unit side soundproof member 140 may be provided in an upper portion of the compressor 211 to simultaneously block noise together with the noise-proof member 110.

Namely, noise generated by the compressor 211 is primarily blocked by the noise-proof member 110, and when a sound absorbing member is attached to the blowing unit side soundproof member 140, the noise may be secondarily absorbed by the sound absorbing member, providing a noise blocking effect. In this case, the sound absorbing member attached to the blowing unit side soundproof member 140 is installed at a certain distance from the compressor 211, so it does not directly affect heat dissipation of the compressor 211.

Also, when a sound absorbing member is not attached to the blowing unit side soundproof member 140, the blowing unit side soundproof member 140 may be configured to reflect noise, rather than absorbing it, to thus suppress noise from being transmitted to an upper side of the compressor 211.

In this case, in order to reflect noise generated by the compressor 211, the blowing unit side soundproof member 140 may have a surface having a curved shape covering an upper portion of the compressor.

Also, the compressor noise suppressing structure 100 according to another embodiment of the present invention may thither include a downwardly extending soundproof member 151 extending from one side of the blowing unit 220 to an upper end of the installation member 120.

The downwardly extending soundproof member 151 may extend from one side of the blowing unit 220 toward the installation member 120 to suppress noise generated by the compressor 212 from being transmitted to the upper end of the humidifier 200.

Also, a plurality of downwardly extending soundproof members may be provided to obtain a noise suppressing effect, and when a plurality of downwardly extending soundproof members are provided, noise can be more effectively blocked.

Meanwhile, the compressor noise suppressing structure 100 according to another embodiment of the present invention may further include an upwardly extending soundproof member 152 extending from an upper portion of the installation member 120. In this case, the upwardly extending soundproof member 152 may extend from an upper portion of the installation member 120 toward the blowing unit 220.

A plurality of upwardly extending soundproof members may be provided to obtain a noise suppressing effect, and when a plurality of upwardly extending soundproof members are provided, noise can be more effectively blocked.

Preferably, in order to improve assembly characteristics, the upwardly extending soundproof member 152 is integrally formed with the installation member 120, like the noise-proof member 110, but the present invention is not limited thereto.

Meanwhile, as illustrated in FIG. 10, referring to an enlarged view of the downwardly extending soundproof member 151 and the upwardly extending soundproof member 152, the downwardly extending soundproof member 151 may extend from the blowing unit 220 toward the installation member 120, and the upwardly extending soundproof member 152 may extend from the installation member 120 toward the blowing unit 220. The downwardly extending soundproof member 151 and the upwardly extending soundproof member 152 may be adjacent and parallel to each other.

In such a case, the downwardly extending soundproof member 151 is not directly in contact with the installation member 120, and the upwardly extending soundproof member 152 is not directly in contact with the blowing unit 220, whereby the downwardly extending soundproof member 151 or the upwardly extending soundproof member 152 is prevented from being brought into contact with the blowing unit 220 or the installation member 120 due to vibrations when the compressor 211 is operated to damage the blowing unit 220 or the installation member 120 or generate noise.

Also, since the downwardly extending soundproof member 151 and the upwardly extending soundproof member 152 are positioned to be adjacent and parallel to each other, noise can be simultaneously blocked.

Meanwhile, referring to FIGS. 10 through 12, in order to suppress noise generated by the compressor 211 from being transmitted to a lateral surface of the installation member 120, a laterally extending soundproof member 160 may be disposed on a lateral surface of the installation member 120 such that it extends from the lateral surface of the installation member 120 toward the housing 230.

As illustrated in FIG. 12, the laterally extending soundproof member 160 may be installed to be spaced apart from the housing 230 so that it cannot be in contact with the housing 230 due to vibrations of the compressor 211, or the like.

Meanwhile, in FIGS. 10 through 12, it is illustrated that the laterally extending soundproof member 160 is only disposed on one surface of the installation member 120, but the present invention is not limited thereto and the laterally extending soundproof member 160 may be provided on a left portion, a right portion, or both of the left and right portions of the installation member 120.

In order to improve assembly characteristics, the laterally extending soundproof member 160 may be integrally formed with the installation member 120, like the noise-proof member 110, but the present invention is not limited thereto.

Hereinafter, an operation and effect of the compressor noise suppressing structure 100 and the dehumidifier 200 according to embodiments of the present invention will be described in detail.

When a refrigerator or the dehumidifier 200 employing the compressor 211 operates, noise is generated by the compressor. The compressor noise suppressing structure 100 according to an embodiment of the present invention is configured to surround the compressor 211 to block noise generated when the compressor 211 is operated.

A desirable structure for blocking noise of the compressor 211 is a configuration of a noise-proof member 110 covering the entire surfaces of the compressor 211. In this case, however, it is difficult to install the connection pipes 150 connecting the compressor 211 to other components such as the condenser 214, so the structure may be configured to have a configuration in which one side of the surfaces covering the compressor 211 is opened. In addition, when the entire surfaces of the compressor 211 are covered with the noise-proof member 110, heat generated by the compressor 211 cannot be effectively dissipated to increase a temperature of the compressor 211 and a load to increase vibrations of the compressor 211. When vibrations generated by the compressor 211 are increased, they serve as an additional noise generation source as being disadvantageous in terms of noise blocking.

Thus, as illustrated in FIGS. 3 through 5, the compressor noise suppressing structure 100 according to an embodiment of the present invention may have a structure in which two sides or one side thereof are opened. In this case, the structure with two open side may have a less noise suppressing effect relative to the structure with one open side, but can effectively dissipate heat generated when the compressor 211 is operated, obtaining an effect of reducing noise generation due to an increased temperature.

Also, the noise blocking effect may be further increased when the partition 122 is disposed in a portion, of the installation member 120, from which the noise-proof member 110 extends, because noise is blocked by the partition 122.

Namely, noise generated by the compressor 211 is primarily blocked by the compressor noise suppressing structure 100 according to an embodiment of the present invention and secondarily blocked by the housing 230, whereby noise can be blocked simultaneously.

Also, in the case of the dehumidifier 200, the condenser 214, the capillary tube 213, the evaporator 212, the blowing unit 220, and the like, may be coupled to the upper surface of the mounting surface 121, whereby space within the dehumidifier 200 can be more effectively utilized.

In the compressor noise suppressing structure 100 according to an embodiment of the present invention, since the installation member 120 and the noise-proof member 110 extending from the installation member 120 are formed as a single component, assembly costs can be reduced and fabrication process is simplified relative to the case in which the installation member 120 and the noise-proof member 110 are separately configured as different components.

The noise suppressing effect of the compressor noise suppressing structure 100 having the foregoing configuration according to an embodiment of the present invention is as shown in Table 1 below.

TABLE 1

| Classification | Number | Left side | Front side | Right side | Rear side | Upper portion | Average |
|---|---|---|---|---|---|---|---|
| Embodiment 1 | Sample 1 (dB) | 35.6 | 35.4 | 36.5 | 35.3 | 36.8 | 35.9 |
| | Sample 2 (dB) | 35.4 | 35.4 | 36.7 | 35.1 | 36.7 | 35.8 |
| | Sample 3 (dB) | 35.1 | 35.3 | 35.9 | 34.9 | 35.7 | 35.4 |
| Embodiment 2 | Sample 1 (dB) | 36.3 | 36.4 | 36.2 | 36.0 | 38.1 | 35.6 |
| | Sample 2 (dB) | 36.8 | 36.7 | 36.0 | 35.8 | 37.7 | 36.6 |
| | Sample 3 (dB) | 36.4 | 36.2 | 36.7 | 36.1 | 38.4 | 36.8 |
| Comparative example | Sample 1 (dB) | 36.7 | 39.8 | 37.1 | 37.1 | 38.9 | 36.8 |

In Table 1, Embodiment 1 shows noise measurement experiment results of the compressor noise suppressing structure 100 in which a front side of the compressor is exposed and a portion of a left side and a portion of an upper side are exposed as illustrated in FIG. 4. It can be seen that average noise of the three cases were measured as approximately 35.7 dB.

Embodiment 2 shows noise measurement experiment results of the compressor noise suppressing structure 100 further including the detachable soundproof member 170. It can be seen that average noise of the three cases was measured as approximately 36.7 dB.

In the comparative example, a sound absorbing unit was installed on a circumference of the compressor 211, without the noise-proof member 110 according to an embodiment of the present invention. It can be seen that average noise was measured as approximately 37.6 dB.

According to the results, in the case of Embodiment 1 and Embodiment 2 in which the noise-proof member 110 according to an embodiment of the present invention is installed, it can be seen that noise of about 2 dB was reduced in comparison to comparative example without the noise-proof member.

Also, Embodiment 1 and Embodiment 2 have lower noise levels than that of comparative example, and it can be seen that the structure in which at least one side of the compressor is opened to easily dissipate heat generated by the compressor 211 has a high noise reduction effect. However, as illustrated in FIGS. 6 and 7, the present invention does not exclude an embodiment in which the detachable soundproof member 170 is installed, and a heat dissipation structure of the compressor 211 may be achieved according to a shape of the detachable soundproof member 170.

Meanwhile, the compressor noise suppressing structure 100 according to another embodiment of the present invention may include a blowing unit side soundproof member 104, the downwardly extending soundproof member 151, the upwardly extending soundproof member 152, and the laterally extending soundproof member 160.

Noise generated by the compressor 211 is primarily blocked by the noise-proof member 110. However, leaked noise is transmitted to an upper portion of the dehumidifier 200 through the blowing unit 220 provided on an upper surface of the noise-proof member 110 or transmitted along a left side or a right side of the installation member 120.

First, the blowing unit side soundproof member 140 is provided on an upper end of the compressor 211. The blowing unit side soundproof member 140 blocks or reflects noise transmitted to the upper end of the compressor 211, rather than having been primarily blocked by the noise-proof member 110 to suppress noise from moving to an upper end of the dehumidifier 200 along the blowing unit 220.

Also, the downwardly extending soundproof member 151 and the upwardly extending soundproof member 152 suppress noise not blocked by the noise-proof member from being transmitted to an upper side of the dehumidifier 200 through space formed between the blowing unit 220 and the installation member 120.

The downwardly extending soundproof member 151 extends from one side of the blowing unit 220 and the upwardly extending soundproof member 152 extends from an upper end of the installation member 120 such that space is formed between the blowing unit 220 and the installation member 120, effectively blocking noise.

In particular, when the downwardly extending soundproof member 151 and the upwardly extending soundproof member 152 are disposed to be adjacent and parallel to each other, noise can be simultaneously blocked, and when a plurality of downwardly extending soundproof members 151 and a plurality of upwardly extending soundproof member 151 are provided, noise can be more effectively blocked.

Also, noise not blocked by the noise-proof member 110 is transmitted along the left or right side of the installation member 120. The laterally extending soundproof member 160 has an effect of blocking noise transmitted along the lateral surface of the installation member 120.

While the present invention has been shown and described in connection with the embodiments, it will be apparent to those skilled in the art that modifications and variations can be made without departing from the spirit and scope of the invention as defined by the appended claims.

The invention claimed is:

1. A compressor noise suppressing structure installed in a device having a compressor, configured to suppress noise from the compressor, the structure comprising:

a base frame, at least a portion of the compressor being installed on the base frame, wherein the base frame has a first end adjacent to the compressor and an opposite end;

an installation member having a first wall spaced apart and opposing a second wall fixed to the base frame, and an upper wall having an upper surface and configured to accommodate a component installed within a housing, the housing forming an outer appearance of the device;

a noise-proof member attached to the installation member and having a first extending plate directly attached to the first wall of the installation member and extending toward the first end of the base frame so as to cover at least a first side of the compressor, and an upper extending plate directly attached to the upper wall of the installation member and extending toward the first end of the base frame so as to cover at least a portion of an upper side of the compressor, a blowing unit installed above the compressor and the installation member;

a blowing unit side soundproof member attached to the blowing unit and extending toward the upper wall of the installation member;

a downwardly extending soundproof member attached to the blowing unit and extending toward the upper wall of the installation member; and an upwardly extending soundproof member attached to the upper wall of the installation member and extending toward the blowing unit, wherein the downwardly extending soundproof member and the upwardly extending soundproof member are positioned to be adjacent and parallel to each other, and wherein the downwardly extending soundproof member and the upwardly extending soundproof member are positioned in a space formed between the blowing unit and the installation member.

2. The structure of claim 1, wherein an upper region of the base frame is divided into a region where the compressor is installed and a region positioned opposite to the compressor, and the installation member includes a partition wall installed between the region where the compressor is installed and the region positioned opposite to the compressor.

3. The structure of claim 1, wherein the installation member includes an installation space.

4. The structure of claim 1, wherein the installation member has a mounting surface formed on the upper surface of the installation member.

5. The structure of claim 1, wherein the noise-proof member further includes a bent plate bent from an end portion of the first extending plate adjacent to the first end of the base frame and extending toward the second wall of the installation member so as to cover at least a portion of a side of the compressor.

6. The structure of claim 1, wherein a surface of the blowing unit side soundproof member has a curved shape configured to cover an upper side of the compressor.

7. The structure of claim 1, further comprising:

at least one laterally extending soundproof member attached to an exterior side of the installation member and extending from a lateral surface of the exterior side of the installation member toward the housing.

8. A dehumidifier comprising:

a blower for receiving humid air introduced thereto;

a dehumidification unit containing a compressor noise suppressing structure, the structure comprising:

a base frame, at least a portion of the compressor being installed on the base frame, wherein the base frame has a first end adjacent to the compressor and an opposite end;

an installation member having a first wall spaced apart and opposing a second wall fixed to the base frame, and an upper surface and configured to accommodate a component installed within a housing, the housing forming an outer appearance of the device;

a noise-proof member attached to the installation member and having a first extending plate attached to the first wall of the installation member and extending toward the first end of the base frame, and an upper extending plate attached to the upper surface of the installation member and extending toward the first end of the base frame;

a blowing unit installed above the compressor and the installation member;

a blowing unit side soundproof member attached to the blowing unit and extending toward the upper surface of the installation member;

a downwardly extending soundproof member attached to the blowing unit and extending toward the upper surface of the installation member; and an upwardly extending soundproof member attached to the upper surface of the installation member and extending toward the blowing unit, wherein the downwardly extending soundproof member and the upwardly extending soundproof member are positioned to be adjacent and parallel to each other, and wherein the downwardly extending soundproof member and the upwardly extending soundproof member are positioned in a space formed between the blowing unit and the installation member;

a water storage tank positioned in an installation space formed by the installation member; and a housing.

9. The structure of claim 1, wherein the first extending plate and the upper extending plate are integrally formed with the installation member.

10. The structure of claim 9, wherein the noise-proof member further includes a second extending plate attached to the second wall of the installation member and extending toward the first end of the base frame, opposite to the first extending plate, so as to cover a second side of the compressor.

11. The structure of claim 9, wherein the compressor noise suppressing structure further comprises a detachable soundproof member attached to the noise-proof member so as to cover a second side of the compressor and at least a portion of the upper side of the compressor.

* * * * *